US005740564A

United States Patent [19]

Hankins et al.

[11] Patent Number: 5,740,564

[45] Date of Patent: Apr. 21, 1998

[54] SOFA HAVING RECLINING SECTION AND FOLDABLE BED

[75] Inventors: J. Doug Hankins; Lance Foster, both of Tupelo, Miss.

[73] Assignee: Action Industries, Inc., Verona, Miss.

[21] Appl. No.: 789,279

[22] Filed: Jan. 28, 1997

[51] Int. Cl.[6] ..... A47C 17/04; A47C 1/037

[52] U.S. Cl. ..... 5/12.1; 5/13; 297/232

[58] Field of Search ..... 5/2.1, 13, 12.1; 297/232; D6/335, 383

[56] References Cited

U.S. PATENT DOCUMENTS

| | | | |
|---|---|---|---|
| 382,743 | 5/1888 | Waldo . | |
| 1,248,702 | 12/1917 | Percival . | |
| 2,087,574 | 7/1937 | Kaufer | 155/112 |
| 3,771,178 | 11/1973 | Inman | 5/13 |
| 3,906,557 | 9/1975 | Barabas | 5/13 |
| 4,301,559 | 11/1981 | Geenberghe | 5/13 |
| 5,064,244 | 11/1991 | Sproule | 297/68 |
| 5,147,108 | 9/1992 | LaPointe | 297/85 |
| 5,271,660 | 12/1993 | LaPointe et al. | 297/85 |
| 5,326,153 | 7/1994 | Muffi | 297/232 |
| 5,360,255 | 11/1994 | Cook et al. | 297/232 |
| 5,474,359 | 12/1995 | Muffi | 297/354.13 |
| 5,480,213 | 1/1996 | Sproule | 297/232 |
| 5,527,092 | 6/1996 | Cook et al. | 297/232 |

*Primary Examiner*—Michael F. Trettel

*Attorney, Agent, or Firm*—Myers Bigel Sibley & Sajovec, LLP

[57] ABSTRACT

A furniture piece comprises: a sofa frame; a plurality of seating sections connected to and associated with the sofa frame, one of which is a reclining seating section; and a foldable bed. The configuration described hereinabove provides both reclining seat and sleeping capability, and does so in the same furniture piece.

31 Claims, 7 Drawing Sheets

SOFA HAVING RECLINING SECTION AND FOLDABLE BED

FIELD OF THE INVENTION

The present invention relates generally to furniture, and more specifically to multifunctional furniture.

BACKGROUND OF THE INVENTION

Furniture items that offer function beyond mere support are becoming common. For example, the so-called "recliner" chair has become quite popular for its ability to move between an upright position and one or more reclined positions, thereby providing the occupant with different options for seating convenience and comfort. Recliner chairs have proven to be sufficiently desirable that reclining capability has been incorporated not only into single seat units (i.e., chairs), but also into multiple seat units, such as love seats, sofas, and sectional units.

Another popular furniture piece that offers function beyond mere support is the so-called "sofa sleeper," which is a sofa that includes a bed stored within a cavity in the sofa frame. Typically, the bed includes three or four sections that can be unfolded to provide a bed that extends away from the sofa frame; the foldable sections are then folded upon each other so that the bed fits within the cavity in the frame. Generally, when the bed is folded, at least one section of the bed provides support beneath the seat cushions of the sofa. Of course, a significant advantage of a sofa-sleeper is that it provides both seating and sleeping capability in the same furniture piece, which reduces the floor space required to provide both of these functions.

Because consumer interest in particular furniture pieces is often driven by appearance, it is important when adding function to a furniture piece that its appearance be attractive to consumers. One appealing aspect of recliner chairs and sofa-sleepers is that each (or both) can be incorporated into existing furniture ensembles or collections without significant modification to existing pieces. For example, the mattress, frame, and folding mechanism of a sofa-sleeper can be configured so that the foldable bed can be included in a sofa of conventional shape and style. As such, a foldable bed can be included in or omitted from a sofa as desired by the consumer without impacting the appearance of the sofa or, therefore, its conformity with the remaining pieces of its ensemble. Similarly, many recliner chairs and reclining sections of sofas and sectional units have reclining mechanisms that are configured so that the appearance of the furniture piece is essentially unaffected by the inclusion or exclusion of the reclining mechanism.

Given the broad consumer interest in functional furniture, there is a desire in this industry for furniture pieces that can provide additional function without adversely impacting appearance.

SUMMARY OF THE INVENTION

In view of the foregoing, it is a first object of the present invention to provide a furniture piece that provides additional function that is not met by prior art furniture pieces.

It is also an object of the present invention to provide such a furniture piece that can be incorporated into typical furniture ensembles without significant impact on appearance and style.

These and other objects are satisfied by the present invention, which provides a furniture piece that includes both a reclining seat and a foldable bed. The furniture piece comprises: a sofa frame; a plurality of seating sections connected to and associated with the sofa frame, one of which is a reclining seating section; and a foldable bed. The configuration described hereinabove provides both reclining seat and sleeping capability, and does so in the same furniture piece.

The reclining seating section includes a reclining mechanism attached to the sofa frame, the seat portion and the backrest portion of the reclining seating section. The reclining mechanism is configured to move the seat portion and the backrest portion between upright and reclined positions. In the upright position, the backrest portion defines a first angle relative to an underlying surface, and in the reclined position, the backrest portion is reclined relative to the sofa frame to define a second angle relative to the underlying surface that is less than the first angle.

The foldable bed comprises a bed frame, a mattress, and a folding mechanism. The folding mechanism is attached to the bed frame and connected with the sofa frame. The bed frame comprises serially, pivotally interconnected body, cavity, and seat sections. The folding mechanism is configured to move the bed frame between folded and unfolded positions, wherein in the unfolded position, the body, cavity and seat sections are generally horizontally disposed and aligned and are positioned to support the mattress, and in the folded position, the seat and body sections are generally horizontally disposed, the cavity section is generally vertically disposed between the body and seat sections, and the mattress is folded upon itself. The foldable bed is positioned in the folded position beneath at least a second one of the plurality of seating sections.

Preferably, the reclining mechanism is a "wall-avoiding" type mechanism which enables the furniture piece to be placed adjacent to a wall without the backrest of the reclining seating section striking the wall during reclining. It is also preferred that the foldable bed be approximately the width of two seating sections of the furniture piece, which is also approximately the width of a standard twin bed.

DETAILED DESCRIPTION OF THE INVENTION

The present invention will now be described more particularly hereinafter with reference to the accompanying drawings, in which an embodiment of the invention is shown. The invention can, however, be embodied in many different forms and should not be limited to the embodiment set forth herein; rather, this embodiment is provided so that this disclosure will be thorough and complete and will fully convey the scope of the invention to those skilled in this art.

Figure 1:
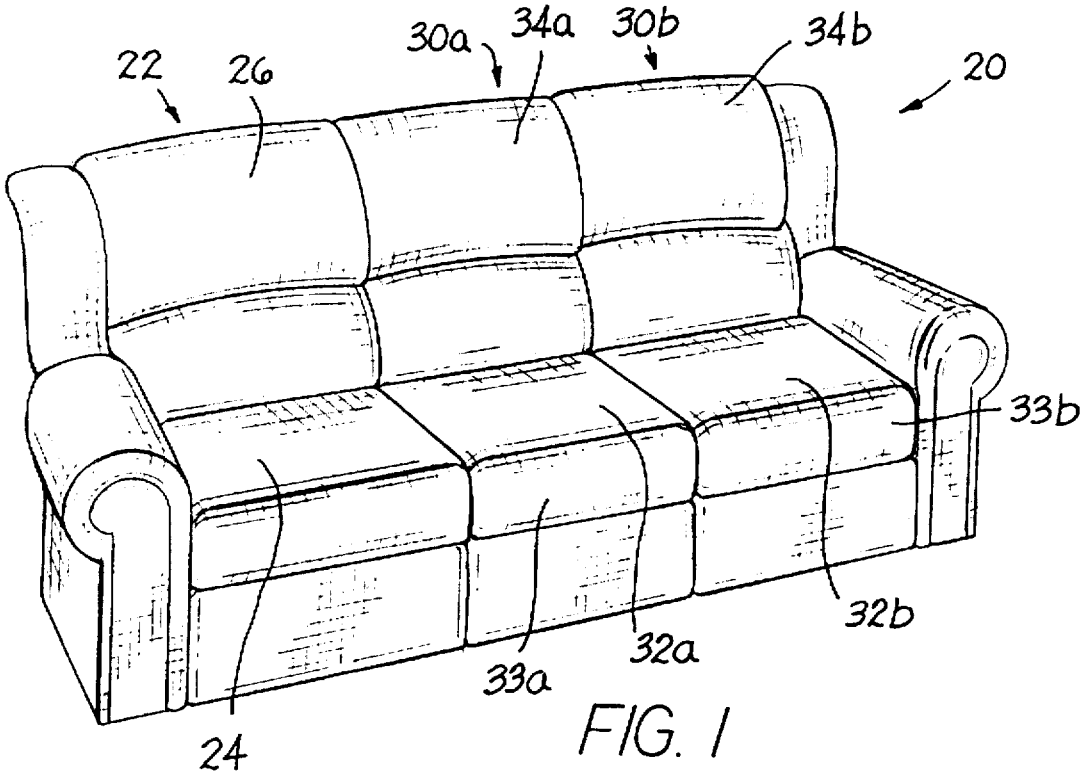
FIG. 1 is a perspective view of a multifunctional seating unit of the present invention with the reclining section in its upright position and the foldable bed in its folded position.

Referring now to the drawings, a three section seating unit 20 is illustrated in FIG. 1. The seating unit 20 includes a reclining seat section 22 and a pair of stationary seat sections 30*a*, 30*b*. The reclining seat section includes a seat portion 24, which includes a seat cushion, and a backrest portion 26. Similarly, the seating sections 30*a*, 30*b* include corresponding seat portions 32*a*, 32*b* (each of which includes a removable seam cushion 33*a*, 33*b*), and corresponding backrest portion 34*a*, 34*b*. The seat portions 24, 32*a*, 32*b* are positioned and oriented to be generally horizontal and substantially coplanar. The seat portions 24, 32*a*, 32*b* are positioned at a comfortable height for sitting (i.e., between about 14 and 20 inches from an underlying surface). The backrest portions 26, 34*a*, 34*b* are generally upright (usually forming an angle of between about 60 and 80 degrees with the underlying surface) and are positioned and oriented to be substantially coplanar.

Figure 2:
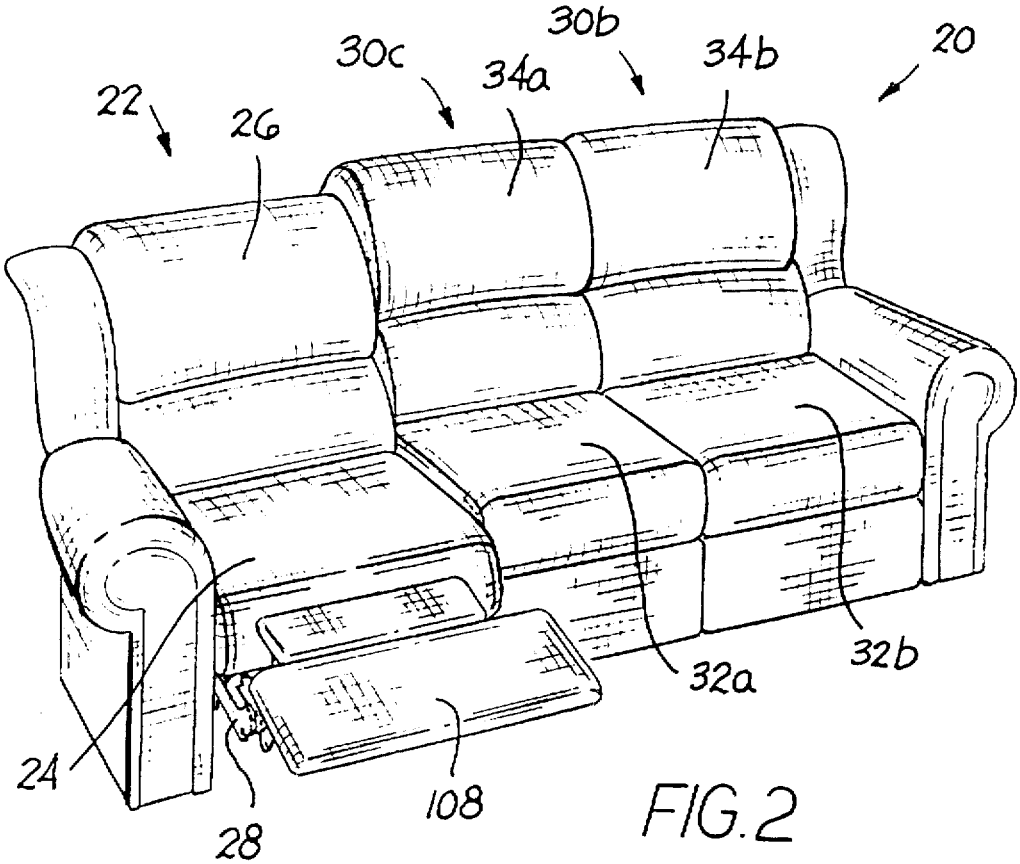
FIG. 2 is a perspective view of the seating unit of FIG. 1 with the reclining section in its TV position.
Figure 3:
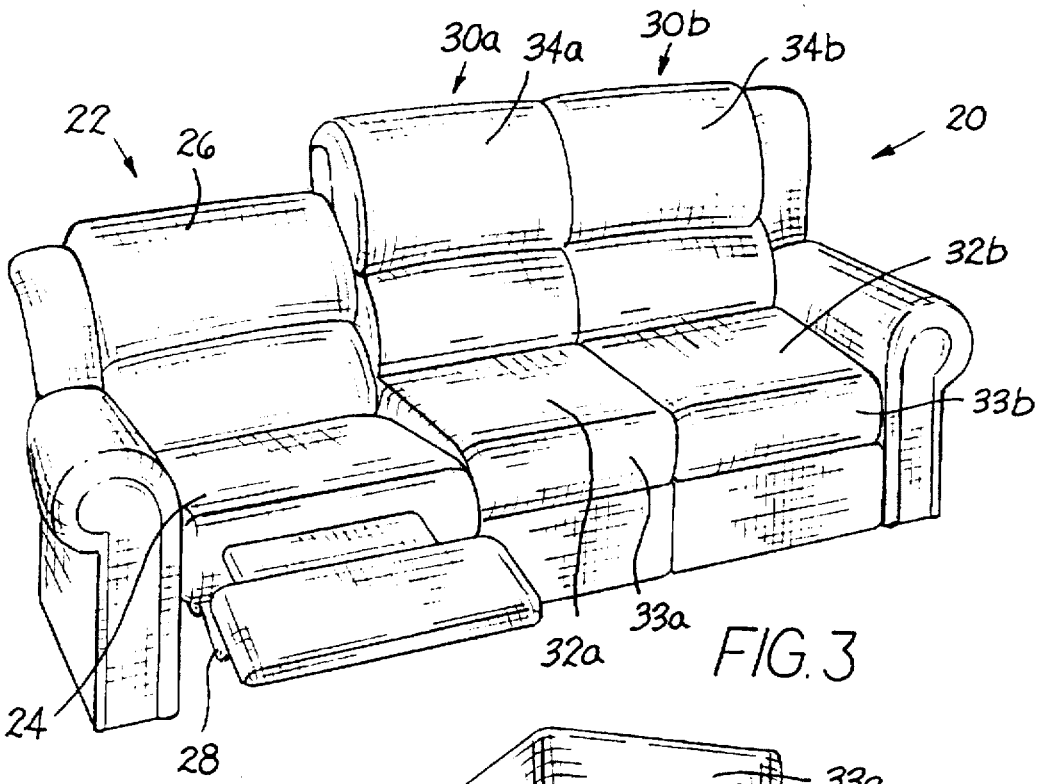
FIG. 3 is a perspective view of the seating unit of FIG. 1 with the reclining section in its fully reclined position.

The reclining seat section 22 is moveable between an upright position shown in FIG. 1, a "TV position" illustrated in FIG. 2, in which a footrest is extended and the seat portion 24 and backrest portion 26 have moved forwardly, and a fully reclined position as illustrated in FIG. 3, in which the backrest portion 26 has pivoted relative to the seat portion 24 to a shallower angle relative to the underlying surface. The reclining motion of the reclining seat section 22 is controlled by a pair of reclining mechanisms 28, one of which is partially visible in FIGS. 2 and 3. The reclining mechanism 28 is actuated by release of a trigger or handle (not shown).

Figure 9:
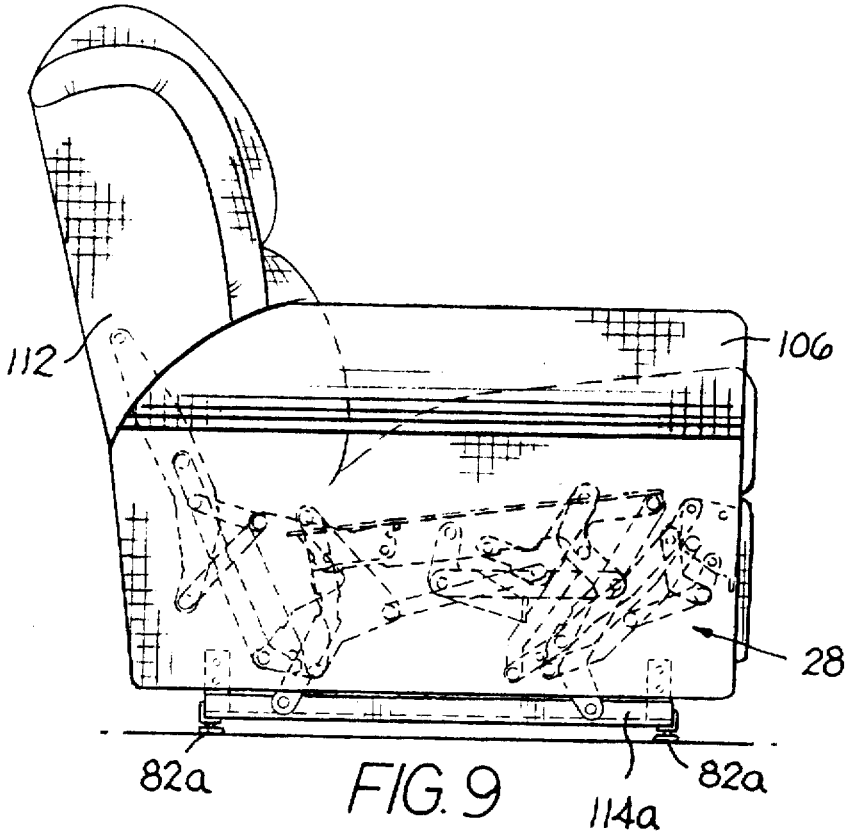
FIG. 9 is an end view of the seating unit of FIG. 1 with the reclining seating section in its upright position.
Figure 10:
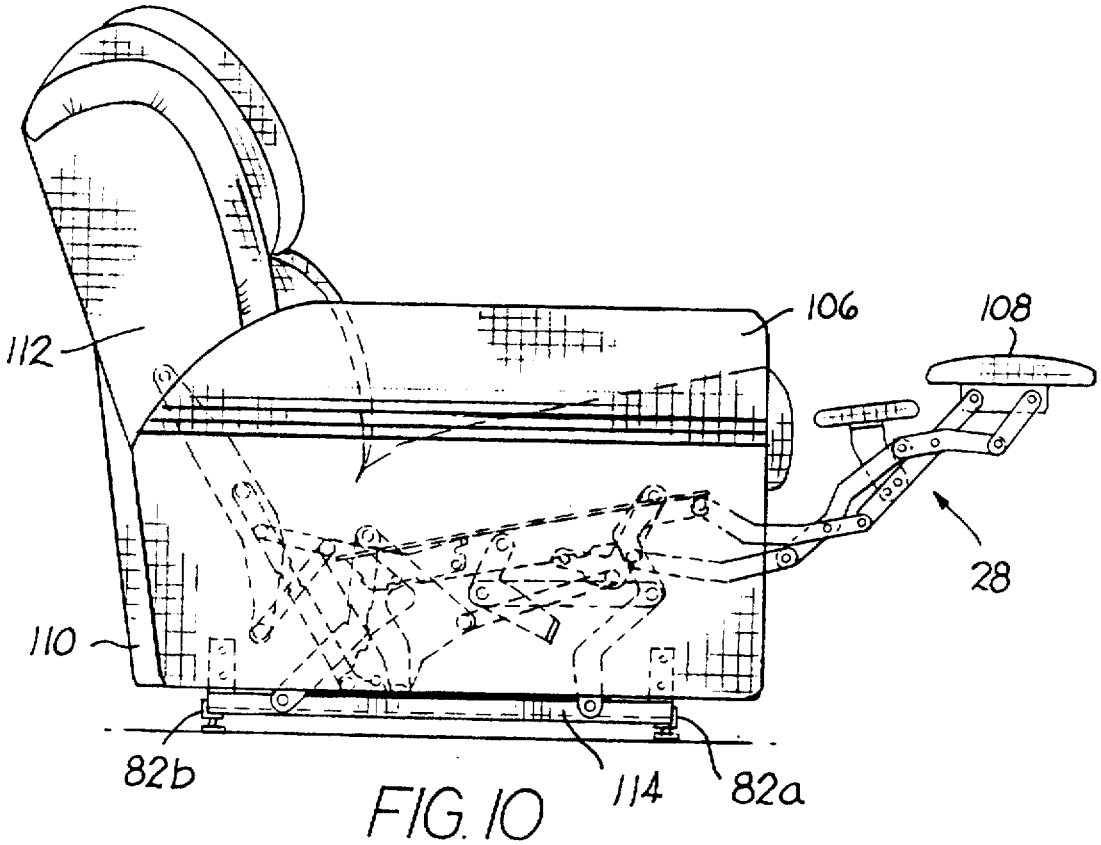
FIG. 10 is an end view of the seating unit of FIG. 1 with the reclining seating unit in its TV position.
Figure 11:
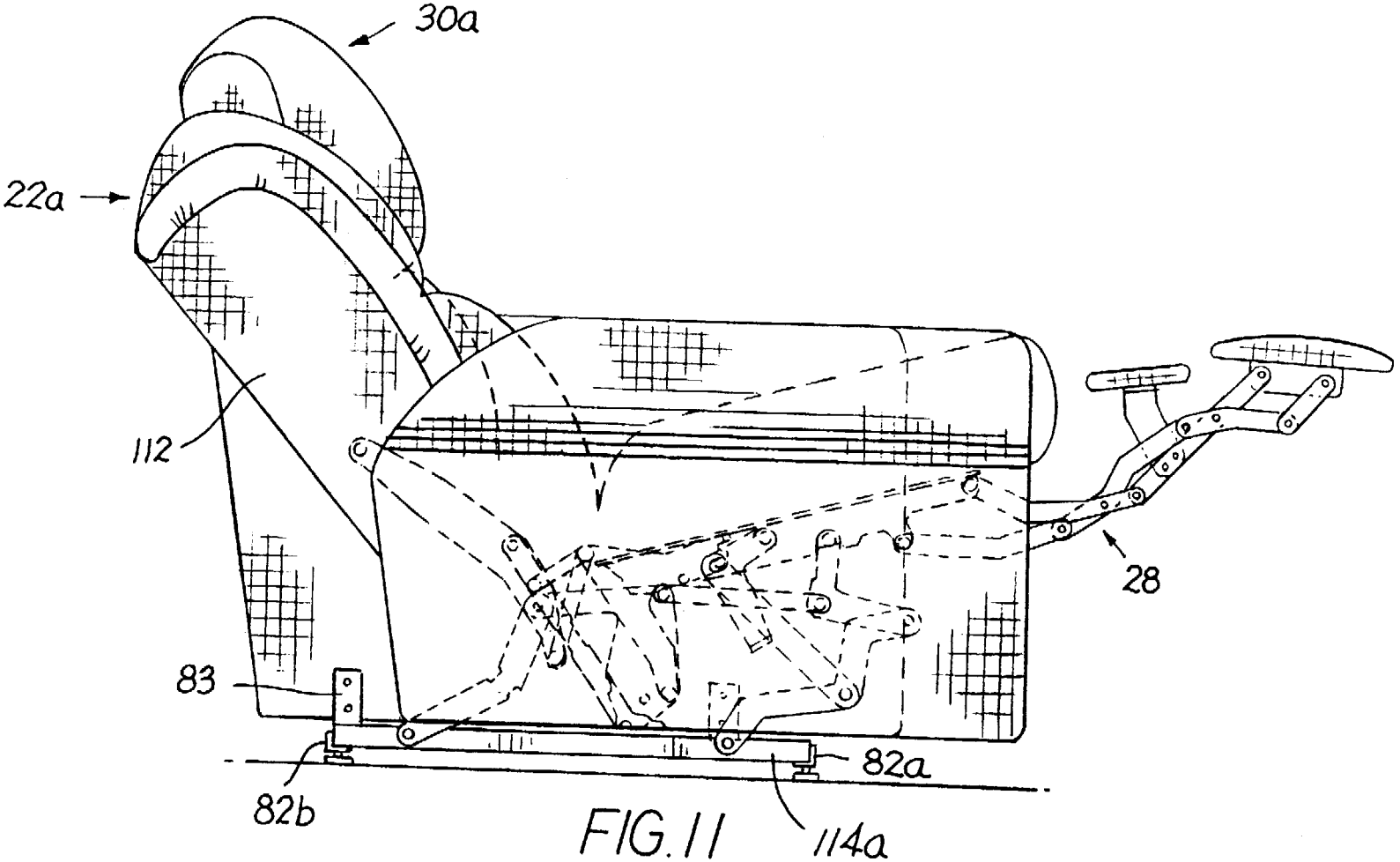
FIG. 11 is an end view of the seating unit of FIG. 1 with the reclining seating unit in its fully reclined position.

The illustrated reclining mechanism 28 (best seen in FIGS. 9 through 11) is exemplary of a type of mechanism known as a wall-avoiding mechanism, in which the seat of the seating unit moves forwardly as the chair moves from the upright to the TV position. Typically, the backrest remains stationary relative to the seat, and thus moves forwardly relative to the underlying surface. Generally, the seat moves forwardly a sufficient distance that when the backrest moves to the fully reclined position, its top edge moves to a position relative to the floor that is only slightly rearward (between about 0 and 4 inches) of its location in the upright position. As a result, the seating unit 20 can be placed so that its backrest portions 26, 34*a*, 34*b* are adjacent a wall, and the reclining section 22 can still be reclined to its TV and fully reclined positions without the backrest 26 striking the wall. The illustrated reclining mechanism 28 is exemplary of wall-avoiding mechanisms, which are well-known to those skilled in this art. Other exemplary wall-avoiding mechanisms are illustrated in U.S. Pat. Nos. 4,226,469; 4,249,722; and 4,337,977 to Rogers.

Although wall-avoiding mechanisms are preferred, other types of reclining mechanisms known to those in this art, such as one-way, two-way, and non-wall avoiding three-way reclining mechanisms, can also be used with the seating unit 20. General descriptions of these mechanisms are offered in U.S. Pat. No. 5,346,277 to Holobaugh. All of the disclosures of the patents listed herein are hereby incorporated by reference herein in their entireties. In addition, a reclining seating section that lacks an extendable footrest can be used, and is preferred when a coffee table or other object that would interfere with the extension of an extendable footrest is to be placed in front of the seating unit 20. The operation of all of these mechanisms is well-known to those skilled n this art and need not be described in detail herein.

Figure 4:
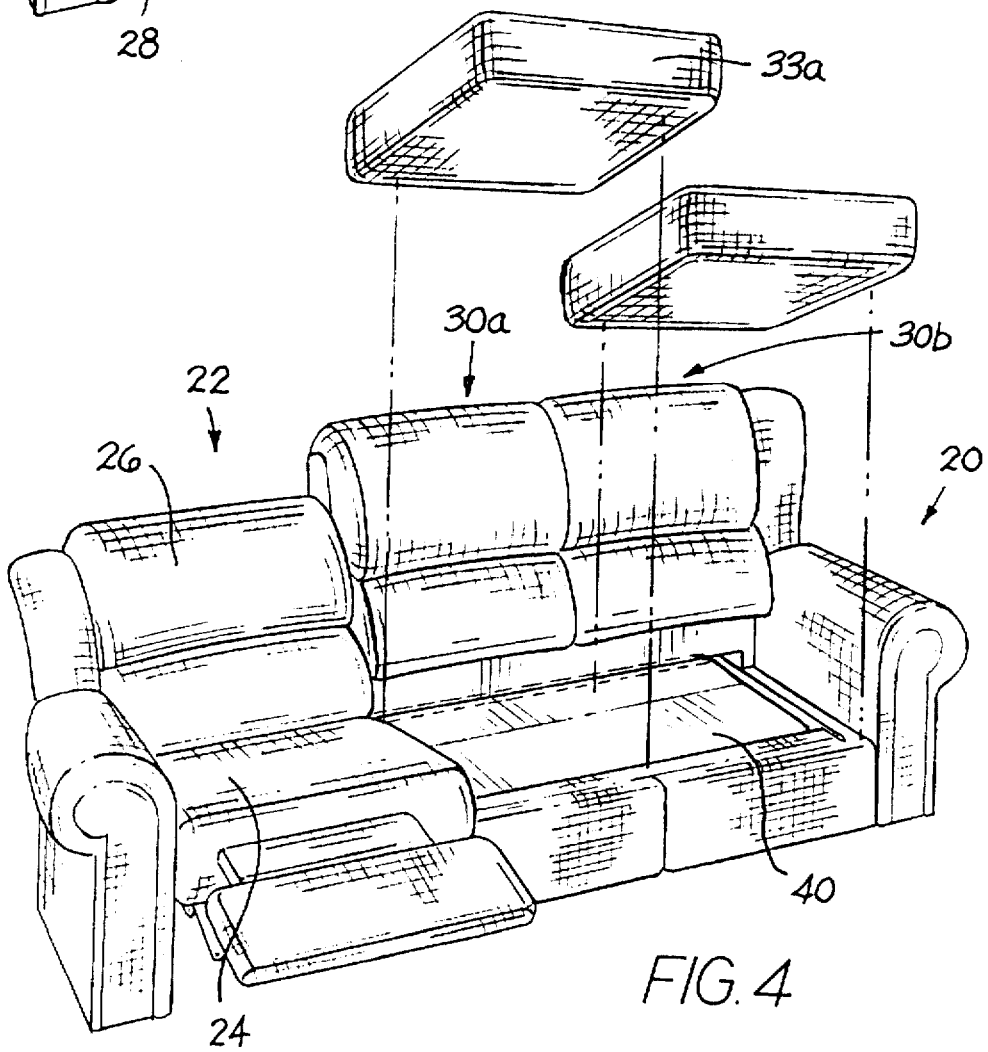
FIG. 4 is an exploded perspective view of the seating unit of FIG. 1 showing the foldable bed in its folded position within the cavity of the bed storage frame.
Figure 5:
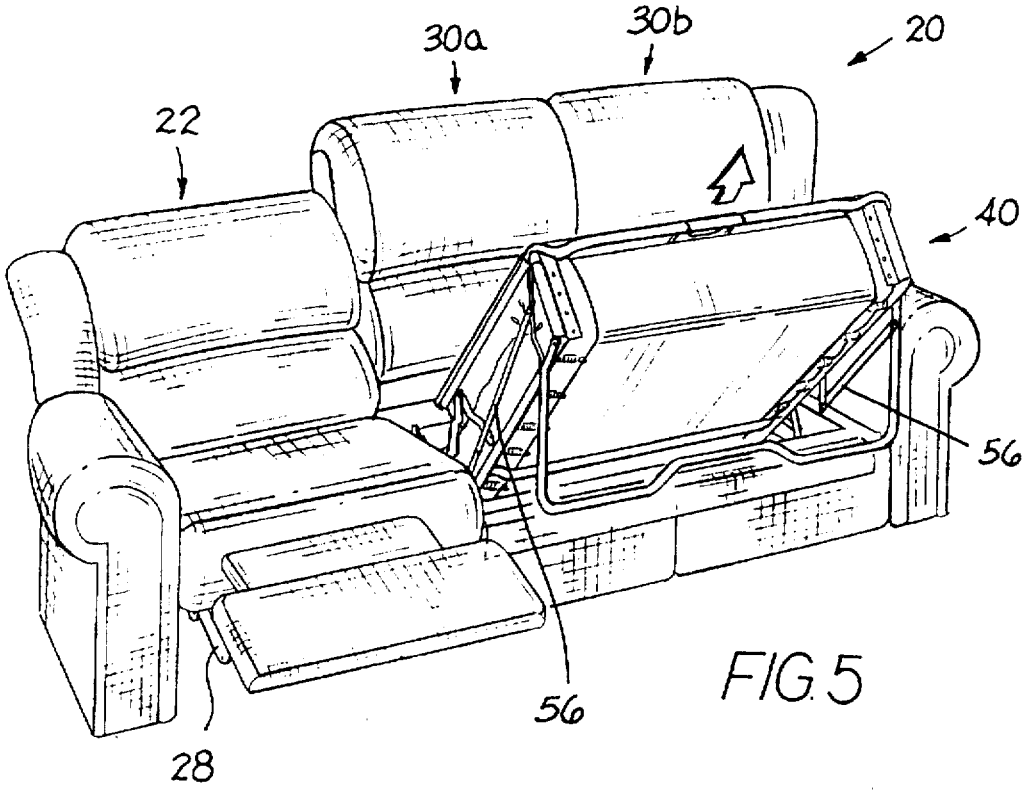
FIG. 5 is a perspective view of the seating unit of FIG. 1 showing how the foldable bed rises from the cavity with the seating unit to unfold.
Figure 6:
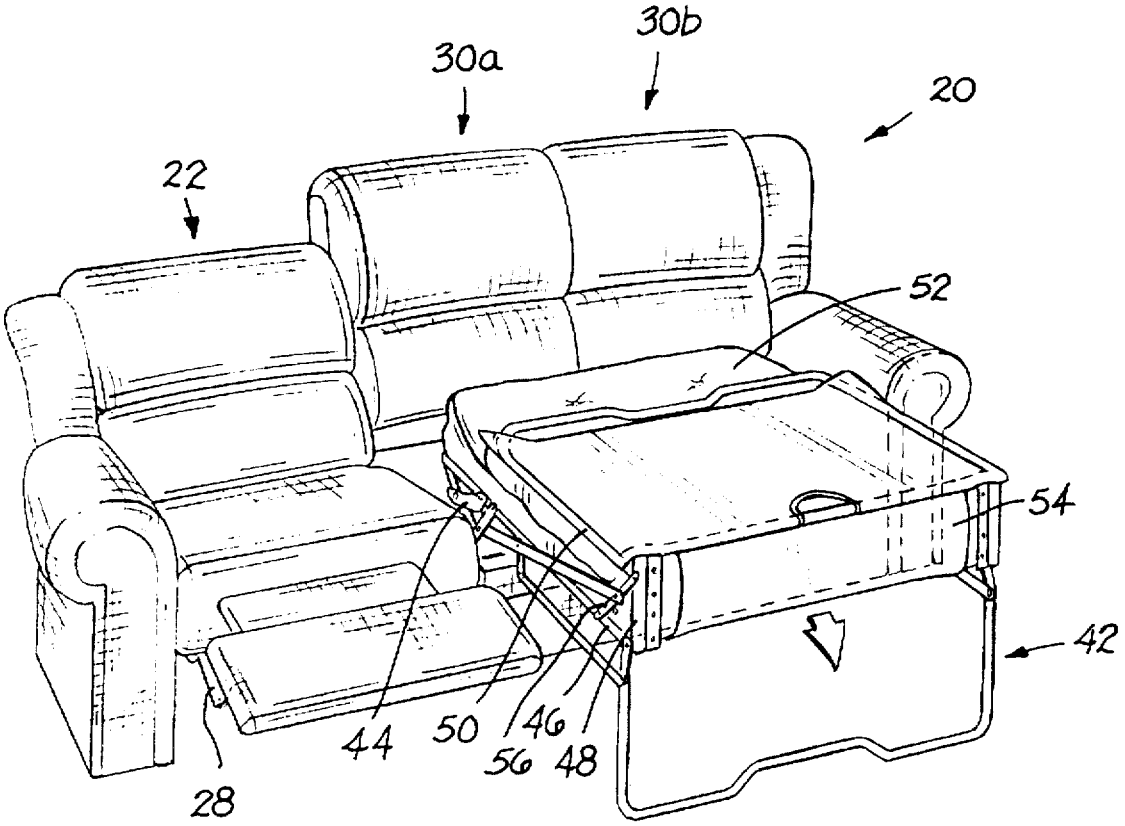
FIG. 6 is a perspective view of the seating unit of FIG. 1 with the foldable bed in a partially unfolded position.
Figure 7:
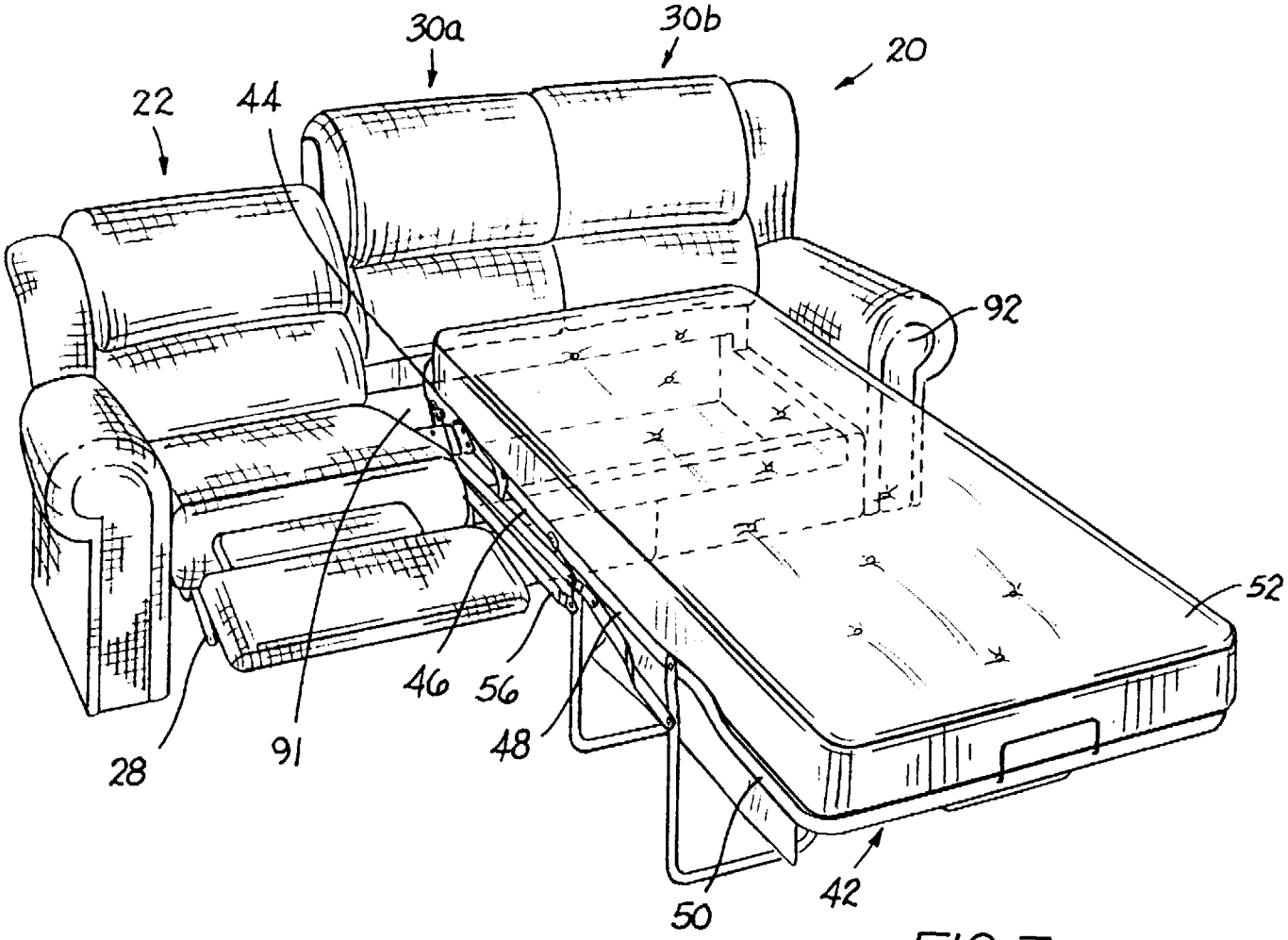
FIG. 7 is a perspective view of the seating unit of FIG. 1 with the foldable bed in its unfolded position.

Referring now to FIG. 4, a foldable bed 40 is stored within the seating unit 20 beneath seat cushions 33*a*, 33*b*. The foldable bed 40 moves from a fully folded position (shown in FIG. 4) through partially unfolded positions (shown in FIGS. 5 and 6) to an unfolded position (shown in FIG. 7). The foldable bed 40 includes a bed support frame 42 that supports a mattress 52; the bed support frame 42 is assisted by a deck 54 that extends between the rails of the bed support frame 42 and thereby underlies the mattress 52 when the foldable bed 40 is in its unfolded position. The bed support frame 42 is subdivided into four serially and pivotally interconnected sections: a head section 44, which is positioned nearest the backrest portions 34*a*, 34*b* of the seating unit 20 when the foldable bed 40 is unfolded; a body section which is pivotally interconnected with the head section 44; a cavity section 48, which is pivotally interconnected with the body section 46; and a seat section 50, which is pivotally interconnected with the cavity section 48 and serves as the foot of the foldable bed 40.

Illustratively and preferably, the foldable bed 40 is approximately the width of two seating sections 32*a*, 32*b* of the seating unit 20. This width is approximately the width of a standard width twin bed (between about 34 and 40 inches), and provides a comfortable sleeping surface for many potential occupants. However, the foldable bed 40 can be of any width that enables a reclining seat section to be included in the seating unit. For example, a four-seat sofa may have a reclining seating section and a foldable bed that is approximately as wide as three seating sections (about the width of a standard foldable bed in a conventional sofa-sleeper). Also, a two-seat love seat may have a reclining seating section and a relatively narrow foldable bed that is the width of only a single seating section. This configuration may simulate a cot and be particularly suitable for a sleeping child. A bed of this width may also be employed in a three section sofa in which two reclining seating units are included (for example, one reclining seating unit can be positioned at each end of the sofa, with the bed in the center).

Movement of the foldable bed 40 is controlled by a pair of folding mechanisms 56, each of which is attached on a respective side of the foldable bed 40 to the bed support frame 42. The folding mechanism 56 is configured and mounted to the bed support frame 42 such that in the folded position of FIG. 4, the head section 44 is generally upright and positioned beneath the backrest positions 34*a*, 34*b*, the body section 46 and the seat section 50 are generally horizontally disposed, and the cavity section 48 is generally vertically disposed between the body and seat sections 46, 50. The folded bed 40 is stored within a cavity in the seating unit. The bed 40 begins to unfold as it is lifted from the seating unit cavity (FIGS. 5 and 6); this movement is followed by the seat section 50 pivoting upwardly. In the unfolded position (FIG. 7), the head, body, cavity, and seat sections 44, 46 48, 50 are horizontally disposed and aligned and positioned to support the mattress 52

The illustrated folding mechanism 56 is exemplary of mechanisms suitable for controlling the movement of a bed frame having head, body, cavity and seat sections. However, other folding mechanisms, such as those illustrated in U.S. Pat. Nos. 4,104,745 to Pacitti, 4,805,065 to Swiderski et al., 4,905,328 to Pokorny, 4,918,770 to Hartline et al., 4,928,331 to Arft, 4,985,945 to Robinson, and 4,780,918 to Hartline, are also suitable for use with the seating unit of the present invention. The operation of these mechanisms is well understood by those skilled in this art and need not be set forth in detail herein. Moreover, it is contemplated that foldable beds that are stored within a sofa cavity but have different folding characteristics, such as those which lack a separate head section, or those which include an additional foot section attached to the foot end of the bed (such as that shown in U.S. Pat. No. 5,257,424 to Rogers), can also be used with the present invention. It is also contemplated that the mattress 52, although illustrated herein with conventional Bonnell-type coil springs, could also comprise "foldable" springs of the type in U.S. Pat. Nos. 4,489,450; 4,620,336 and 5,184,809 to Miller.

Figure 8:
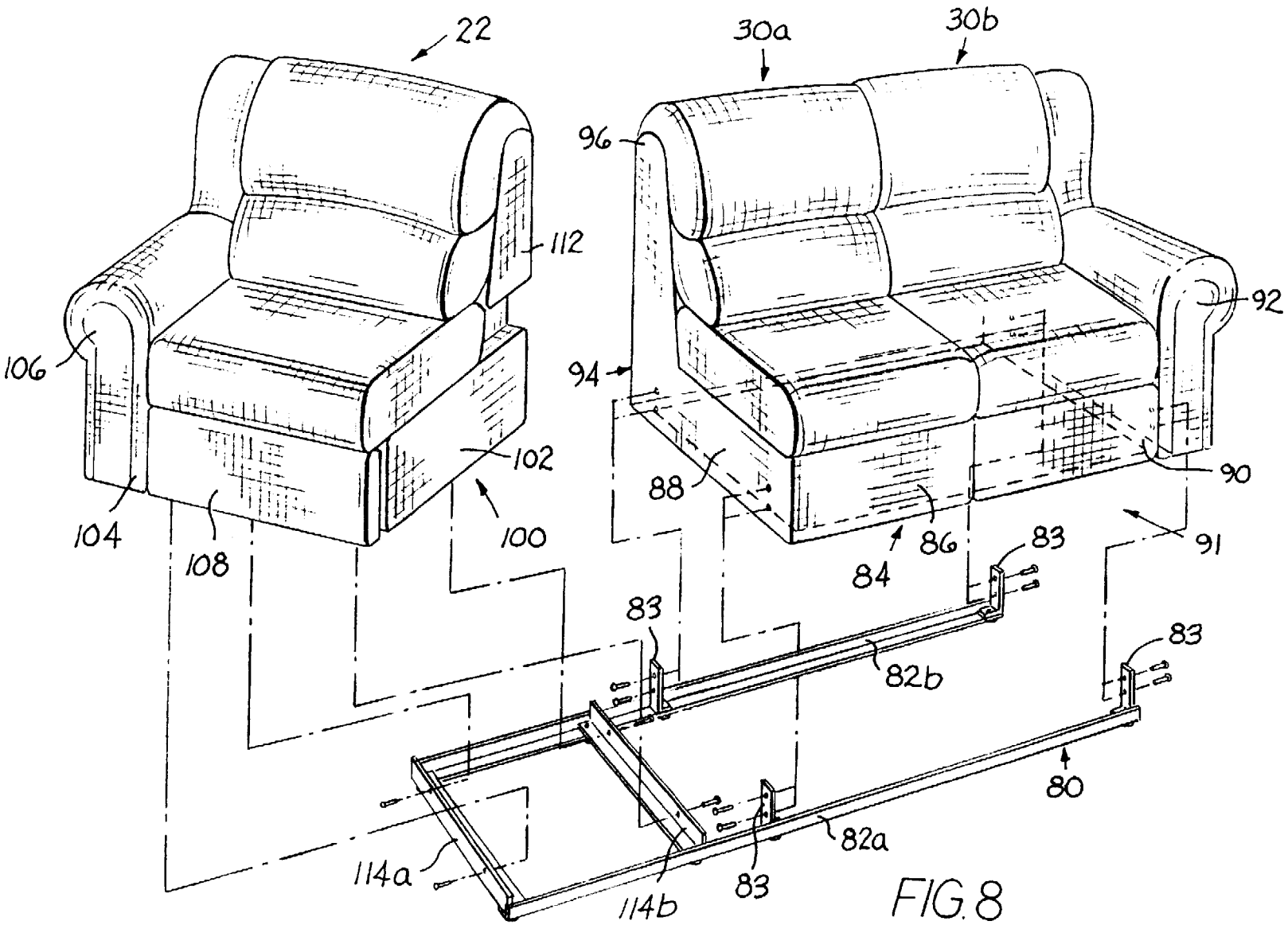
FIG. 8 is an exploded perspective view of the seating unit of FIG. 1 showing the base rails upon which the bed storage frame and recliner frame are mounted.

FIG. 8 illustrates how the reclining seat section 22, the seat sections 32*a*, 32*b*, and the foldable bed 40 are mounted to form an integral unit. A sofa frame 80 comprises a pair of transversely extending base rails 82*a*, 82*b*, each of which extend almost the full length of the seating unit 20. The foldable bed 40 is stored within a bed storage frame 84, which includes a front wall 86, an internal side wall 88, a lateral side wall 90, and a rear wall The front wall 86, the internal and lateral side walls 88, 90, and the rear wall 94 are fixed to one another to define a generally rectangular storage cavity 91 An armrest unit 92 is fixed to the lateral side wall 90. A backrest assembly 96 is mounted above the rear wall 94 and forms the internal structure of the backrest portions 34*a*, 34*b*.

Still referring to FIG. 8, the bed storage frame 84 is mounted to the sofa frame 80 via four mounting brackets 83, two of which are mounted to the internal side wall 88, and two of which are mounted to the lateral side wall 90. All of the mounting brackets are then mounted to a corresponding base rail 82*a*, 82*b*. The foldable bed 40 is then attached to the bed storage frame 84 by securing mounting brackets of the folding mechanism 56 to the internal side wall 88 and the lateral side wall 90. The folding mechanism 56 is then attached at appropriate locations along the head, body, cavity and seat sections 44, 46, 48, 50 to control the folding and unfolding of the foldable bed 40 into and out of the storage cavity 91.

The reclining seat section 22 (FIGS. 8 through 11) is mounted to the sofa frame 80 in much the manner as reclining seat sections that are included in modular sections of prior art sofas. The reclining seat section 22 includes a recliner frame 100, which is defined by an internal side wall 102, a lateral side wall 104 that is attached to an armrest unit 106, and a rear wall 110. The recliner frame 100 is mounted to the base rails 82*a*, 82*b* via a pair of recliner base fixtures 114*a*, 114*b* that extend between the base rails 82*a*, 82*b* outside of the storage cavity 91. The reclining mechanisms 28 mount directly to the recliner base fixtures 114*a*, 114*b* then are mounted to the internal side wall 102 and the lateral side wall 104, respectively, as well as to a backrest assembly 112 and a footrest panel 108, which serve as the backrest and the front wall, respectively, of the reclining seating section 22.

Notably, the backrest assembly 112, which forms the internal structure of the backrest portion 26, is not fixed to the rear wall 100, but instead is able to pivot relative thereto as directed by the reclining mechanisms 28. Because the side walls 102, 104 and the rear wall 110 of the recliner frame 100 are fixed relative to each other, when the reclining seat section 22 is moved between its upright and reclined positions (FIGS. 9 through 11), the entire recliner frame 100, which includes the armrest unit 106, moves as a single unit. The backrest assembly 112 can pivot relative to the recliner frame 100 and does so as the reclining seat section 22 moves from its TV position to its fully reclined position. The footrest panel 108 is free to extend forwardly of the seat portion 24 and be disposed generally horizontally to support an occupant's legs when the reclining seating section is in its TV and fully reclined positions.

As noted above, although the illustrated three-way wall-avoiding reclining seating section 22 is preferred, as it provides two different reclined positions and can be incorporated into a sofa that can still be placed with its backrest against a wall, other types of reclining seating units, many of which have been included in multi-seat seating units, can also be employed. If another variety of reclining unit is to be employed, it can be mounted onto the sofa frame 80 in much the manner illustrated herein; in other words, it can be manufactured as a separate unit, then attached to a unifying structure such as the illustrated sofa frame 80.

The advantages of the seating unit 20 are clear. First, the seating unit 2 provides an independently-operating reclining seat section and a foldable bed in the same furniture unit. Combining these features into a single furniture piece saves floor space and should reduce cost to the consumer. Second, both of the capabilities are provided in a furniture piece that can be easily incorporated into an existing furniture ensemble because the style of the pieces can be retained.

The foregoing embodiment is illustrative of the present invention, and is not to be construed as limiting thereof. The invention is defined by the following claims, with equivalents of the claims to be included therein.

That which is claimed is:

1. A unit of furniture comprising:

a sofa frame;

a plurality of seating sections connected to and associated with said sofa frame, each of said seating sections including a corresponding generally horizontally disposed seat portion and a corresponding generally upright backrest portion positioned above said seat section;

a first one of said plurality of seating sections being a reclining seating section which includes a reclining mechanism attached to said sofa frame, said seat portion and said backrest portion of said first seating section, said reclining mechanism being configured to move said seat portion and said backrest portion between upright and reclined positions, wherein in the upright position, said backrest portion defines a first angle relative to an underlying surface, and in said reclined position, said backrest portion is reclined relative to said sofa frame to define a second angle relative to the underlying surface that is less than said first angle; and a foldable bed comprising a bed frame, a mattress, and a folding mechanism, said folding mechanism being attached to said bed frame and connected with said sofa frame, said bed frame comprising serially interconnected body, cavity, and seat sections, said folding mechanism being configured to move said bed frame between folded and unfolded positions, wherein in the unfolded position, said body, cavity and seat sections are generally horizontally disposed and aligned and are positioned to support said mattress, and in the folded position, said seat and body sections are generally horizontally disposed, said cavity section is generally vertically disposed between said body and seat sections, and said mattress is folded upon itself;

said foldable bed being positioned in the folded position beneath at least a second one of said plurality of seating sections.

2. The unit of furniture defined in claim 1, wherein said unit of furniture comprises a three-section sofa.

3. The unit of furniture defined in claim 1, wherein said foldable bed resides beneath two of said plurality of seating sections when said foldable bed is in the folded position.

4. The unit of furniture defined in claim 1, wherein said reclining mechanism is a wall-avoiding mechanism that is configured such that, as said reclining seating section moves to a reclined position, said backrest of said reclining seating section moves such that a top edge thereof moves rearwardly relative to said sofa frame between 0 and 4 inches.

5. The unit of furniture defined in claim 1, wherein said backrest of said second seating section is stationary relative to said sofa frame.

6. The unit of furniture defined in claim 1, wherein said bed frame comprises a head section pivotally interconnected with said body section, and wherein in the unfolded position, said head section is generally horizontally disposed and aligned with said body, cavity, and seat sections, and wherein in the folded position, said head section is generally upright and positioned beneath said backrest of said second seating section.

7. The unit of furniture defined in claim 1, wherein said first seating section further includes a recliner frame that comprises a rear wall and first and second side walls mounted thereto, and also further includes a second reclining mechanism, and wherein each of said reclining mechanisms is mounted to a respective said first and second side walls such that said recliner frame moves forwardly relative to said sofa frame as said first seating section moves from the upright position to a reclined position.

8. The seating unit defined in claim 7, wherein said first seating section further comprises a footrest panel connected to said reclining mechanisms, and wherein in the upright position, said footrest panel is generally upright and beneath a front edge of said seat portion, and in said reclined position, said footrest panel is spaced apart from said seat portion and is generally horizontally disposed so that it serves as a footrest to a seated occupant.

9. The unit of furniture defined in claim 1, further comprising an armrest at each lateral end thereof.

10. A unit of furniture comprising:

a sofa frame;

a plurality of seating sections connected to and associated with said sofa frame, each of said seating sections including a corresponding generally horizontally disposed seat portion and a corresponding generally upright backrest portion positioned above said seat section;

a first one of said plurality of seating sections being a reclining seating section which includes a reclining mechanism attached to said sofa frame, said seat portion and said backrest portion of said first seating section, said reclining mechanism being a zero-wall proximity mechanism configured to move said seat portion and said backrest portion between upright and reclined positions, wherein in the upright position, said backrest portion defines a first angle relative to an underlying surface, and in said reclined position, said seat portion has moved forwardly, and said backrest portion has moved to a reclined orientation relative to the underlying surface that defines a second angle that is greater than the first angle, and also moves such that a top edge thereof moves rearwardly relative to said sofa frame between about 0 and 4 inches; and a foldable bed comprising a bed frame, a mattress, and a folding mechanism, said folding mechanism being attached to said bed frame and connected with said sofa frame, said bed frame comprising serially interconnected body, cavity, and seat sections, said folding mechanism being configured to move said bed frame between folded and unfolded positions, wherein in the unfolded position, said body, cavity and seat sections are generally horizontally disposed and aligned and are positioned to support said mattress, and in the folded position, said seat and body sections are generally horizontally disposed, and said cavity section is generally vertically disposed between said body and seat sections, and said mattress is folded upon itself;

said foldable bed being positioned in the folded position beneath at least a second one of said plurality of seating sections, said second seating section having a backrest that is stationary relative to said sofa section.

11. The unit of furniture defined in claim 10, wherein said backrest of said second seating section is stationary relative to said sofa frame.

12. The unit of furniture defined in claim 10, wherein said unit of furniture comprises a three-section sofa.

13. The unit of furniture defined in claim 10, wherein said foldable bed resides beneath two of said plurality of seating sections when said foldable bed is in the folded position.

14. The unit of furniture defined in claim 10, wherein said bed frame comprises a head section pivotally interconnected with said body section, and wherein in the unfolded position, said head section is generally horizontally disposed and aligned with said body, cavity, and seat sections, and wherein in the folded position, said head section is generally upright and positioned beneath said backrest of said second seating section.

15. The unit of furniture defined in claim 10, wherein said first seating section further includes a recliner frame that comprises a rear wall and first and second side walls mounted thereto, and also further includes a second reclining mechanism, and wherein each of said reclining mechanisms is mounted to a respective said first and second side walls such that said recliner frame moves forwardly relative to said sofa frame as said first seating section moves from the upright position to a reclined position.

16. The seating unit defined in claim 15, wherein said reclining seating section further comprises a footrest panel connected to said reclining mechanisms, and wherein in the upright position, said footrest panel is generally upright and beneath a front edge of said seat portion, and in said reclined position, said footrest panel is spaced apart from said seat portion and is generally horizontally disposed so that it serves as a footrest to a seated occupant.

17. The unit of furniture defined in claim 10, wherein said further comprising an armrest at each lateral end thereof.

18. A unit of furniture comprising:

a sofa frame;

a plurality of seating sections connected to and associated with said sofa frame, each of said seating sections including a corresponding generally horizontally disposed seat portion and a corresponding generally upright backrest portion positioned above said seat section;

a first one of said plurality of seating sections being a reclining seating section which includes a reclining mechanism attached to said sofa frame, said seat portion and said backrest portion of said first seating section, said reclining mechanism being configured to move said seat portion and said backrest portion between upright and reclined positions, wherein in the upright position, said backrest portion defines a first angle relative to an underlying surface, and in said reclined position, said backrest portion is reclined relative to said sofa frame to define a second angle relative to the underlying surface that is less than said first angle; and a foldable bed comprising a bed frame, a mattress, and a folding mechanism, said folding mechanism being attached to said bed frame and connected with said sofa frame, said bed frame comprising serially interconnected body, cavity, and seat sections, said folding mechanism being configured to move said bed frame between folded and unfolded positions, wherein in the unfolded position, said body, cavity and seat sections are generally horizontally disposed and aligned and are positioned to support said mattress, and in the folded position, said seat and body sections are generally horizontally disposed, and said cavity section is generally vertically disposed between said body and seat sections, and said mattress is folded upon itself;

said foldable bed being positioned in the folded position beneath at least a second one of said plurality of seating sections, and said second seating section being stationary relative to said sofa frame.

19. The unit of furniture defined in claim 18, wherein said unit of furniture comprises a three-section sofa.

20. The unit of furniture defined in claim 18, wherein said foldable bed resides beneath two of said plurality of seating sections when said foldable bed is in the folded position.

21. The unit of furniture defined in claim 18, wherein said bed frame comprises a head section pivotally interconnected with said body section, and wherein in the unfolded position, said head section is generally horizontally disposed and aligned with said body, cavity, and seat sections, and wherein in the folded position, said head section is generally upright and positioned beneath said backrest of said second seating section.

22. The unit of furniture defined in claim 18, wherein said first seating section further includes a recliner frame that comprises a rear wall and first and second side walls mounted thereto, and also further includes a second reclining mechanism, and wherein each of said reclining mechanisms is mounted to a respective said first and second side walls such that said recliner frame moves forwardly relative to said sofa frame as said first seating section moves from the upright position to a reclined position.

23. The seating unit defined in claim 22, wherein said reclining seating section further comprises a footrest panel connected to said reclining mechanisms, and wherein in the upright position, said footrest panel is generally upright and beneath a front edge of said seat portion, and in said reclined position, said footrest panel is spaced apart from said seat portion and is generally horizontally disposed so that it serves as a footrest to a seated occupant.

24. The unit of furniture defined in claim 18, further comprising an armrest at each lateral end thereof.

25. A unit of furniture comprising:

a sofa frame;

a trio of seating sections associated with said sofa frame, each of said seating sections including a corresponding generally horizontally disposed seat portion and a corresponding generally upright backrest portion positioned above said seat section;

a first one of said trio of seating sections being a reclining seating section which includes a reclining mechanism attached to said sofa frame, said seat portion and said backrest portion of said first seating section, said reclining mechanism being configured to move said seat portion and said backrest portion between upright and reclined positions, wherein in the upright position, said backrest portion defines a first angle relative to an underlying surface, and in said reclined position, said backrest portion is reclined relative to said sofa frame to define a second angle relative to the underlying surface that is less than said first angle; and a foldable bed comprising a bed frame, a mattress, and a folding mechanism, said folding mechanism being attached to said bed frame and connected with said sofa frame, said bed frame comprising serially interconnected body, cavity, and seat sections, said folding mechanism being configured to move said bed frame between folded and unfolded positions, wherein the unfolded position, said body, cavity and seat sections are generally horizontally disposed and aligned and are positioned to support said mattress, and in the folded position, said seat and body sections are generally horizontally disposed, and said cavity section is generally vertically disposed between said body and seat sections, and said mattress is folded upon itself;

said foldable bed being positioned in the folded position in a cavity in said sofa frame located beneath at a second and a third one of said trio of seating sections.

26. The unit of furniture defined in claim 25, wherein said reclining mechanism is a wall-avoiding mechanism that is configured such that, as said reclining seating section moves to a reclined position, said backrest of said reclining seating section moves such that a top edge thereof moves rearwardly relative to said sofa frame between 0 and 4 inches.

27. The unit of furniture defined in claim 25, wherein said bed frame comprises a head section pivotally interconnected with said body section, and wherein in the unfolded position, said head section is generally horizontally disposed and aligned with said body, cavity, and seat sections, and wherein in the folded position, said head section is generally upright and positioned beneath said backrest of said second seating section.

28. The unit of furniture defined in claim 25, wherein said first seating section further includes a recliner frame that comprises a rear wall and first and second side walls mounted thereto and also further includes a second reclining mechanism, and wherein each of said reclining mechanisms is mounted to a respective said first and second side walls such that said recliner frame moves forwardly relative to said sofa frame as said first seating section moves from the upright position to a reclined position.

29. The seating unit defined in claim 28, wherein said reclining seating section further comprises a footrest panel connected to said reclining mechanisms, and wherein in the upright position, said front wall is generally upright and beneath a front edge of said seat portion, and in said reclined position, said front wall is spaced apart from said seat portion and is generally horizontally disposed so that it serves as a footrest to a seated occupant.

30. The unit of furniture defined in claim 25, further comprising an armrest at each lateral end thereof.

31. A base frame for a furniture piece, comprising:

a pair of generally parallel and spaced-apart base rails;

a pair of generally parallel brackets fixed to and extending between said base rails, each of said brackets being spaced apart from each other and including a plurality of apertures, said apertures being positioned relative to each other to receive a reclining mechanism for a reclining seating unit; and a pair of generally parallel side walls fixed to and extending between said base rails, each of said side walls being sized, configured and positioned from each other to receive a folding mechanism for a foldable bed.

* * * * *